US005380694A

United States Patent [19]

Krebs

[11] Patent Number: 5,380,694

[45] Date of Patent: Jan. 10, 1995

[54] THERMOSENSITIVE RECORDING ELEMENT

[75] Inventor: Robert R. Krebs, Dallas, Tex.

[73] Assignee: International Paper Company, Purchase, N.Y.

[21] Appl. No.: 893,139

[22] Filed: Jun. 3, 1992

[51] Int. Cl.[6] ..... B41M 5/30; B41M 5/36; B41M 5/40

[52] U.S. Cl. ..... 503/214; 427/152; 503/200; 503/226

[58] Field of Search ..... 503/200, 226; 427/152, 427/214

[56] References Cited

U.S. PATENT DOCUMENTS 4,336,306 6/1982 Fellows ..... 428/341
4,614,956 9/1986 Miyauchi ..... 503/200

FOREIGN PATENT DOCUMENTS 011335 9/1983 European Pat. Off. ..... 503/226
0400485 5/1990 European Pat. Off. ..... 503/226
PCT/US88/-
04080 11/1988 WIPO ..... 503/226

*Primary Examiner*—B. Hamilton Hess
*Attorney, Agent, or Firm*—Ostrager, Chong & Flaherty

[57] ABSTRACT

A thermosensitive recording element comprising in order (a) a support, (b) at least one thermal layer comprising an organic polymeric binder, a substantially colorless electron donating dye precursor and an electron accepting compound capable of forming color by reacting with said dye precursor, and (c) a layer comprising a non-binder containing solution of a crosslinking agent wherein said agent forms a diol or ether-type bond with the binder is described. These elements have wide application in the printing industry.

23 Claims, No Drawings

THERMOSENSITIVE RECORDING ELEMENT

FIELD OF THE INVENTION

This invention relates to thermosensitive recording elements and processes for preparing said elements. More particularly, this invention relates to thermosensitive recording elements comprising (a) a support, (b) at least one thermal layer, and (c) an additional overcoat layer having a non-binder containing solution of a crosslinking agent wherein said agent forms an ether or diol-type bond with the binder.

BACKGROUND OF THE INVENTION

Thermosensitive recording elements have wide application in the printing industry. For example, thermosensitive recording elements have been used in instruments for recording measurements, facsimiles, printers, thermal devices for computers, devices for preparing architectural and engineering drawings, and automatic vending machines for dispensing railroad tickets and luggage tags. In addition, thermosensitive recording elements have been used in devices for (a) printing thermal labels, (b) recording geophysical data, and (c) recording medical data.

Conventional thermosensitive recording elements generally comprise a support and a thermosensitive recording layer provided thereon. The thermosensitive recording layer primarily contains a binder, a substantially colorless electron donating dye precursor and an electron accepting compound also known as a developer. Heat is applied to the element by means of a thermal head, a thermal pen or laser beam. Upon heating, the dye precursor instantaneously reacts with the electron accepting compound to form a recorded image.

It has been found that defects in the imaging surface of thermosensitive recording elements can be easily obtained. For example, rubbing the element gently with hard objects such as paper clips, fingernails, and dirt particles or even folding the element can result in undesirable imprints in the imaging surface. This presents a barrier to their use in the printing industry.

Abrasion resistance can be greatly improved by separating the imaging components, i.e., by separating the colorless dye precursor from the developer. This is achieved by applying, for example, the developer containing coating composition to a support that is first coated with the dye precursor containing composition. However, due to the hydrophilic nature of the polymeric binders in the two component compositions, these coatings are subject to image development when stained with water.

Another way of improving abrasion resistance in thermosensitive recording elements is the use of high gloss coatings. The use of high gloss coatings is advantageous in preparing thermal printed labels, tags, or material for advertising. Such coatings can be produced by adding a top coating containing film forming polymers such as polyvinylalcohol or acrylic-methacrylic copolymers over the outermost layer, for example, the developer containing layer produced by the two coating process. However, polymer containing top coats such as these are subject to image development when stained with water. In addition, the low softening point of such polymers causes the element to adhere to the print head of thermal printers, and thus, images of poor quality are produced. The additional layer also adds to the cost of the thermosensitive element.

Improved abrasive resistance has also been achieved by the addition of a crosslinking agent to a dispersion containing a polymeric binder and developer. Dialdehydes, such as glyoxal, have been used as crosslinking agents and, along with small quantities of an acid catalyst such as p-toluenesulfonic acid (PTSA), have been added to the binder/developer dispersion. Although coating compositions such as these do produce improved abrasion resistance, there is a problem with the crosslinking agent prematurely crosslinking with the polymeric binder. Such premature crosslinking causes the coating to become viscous and thus the ability to coat becomes dependent upon the type of coating apparatus used by the operator. To compensate for this, either a different crosslinking agent must be used or the concentration of the crosslinking agent must be carefully controlled so that the viscosity of the coating remains in a workable range for application by the particular coating apparatus.

Accordingly, there is a need for a thermosensitive recording element that has improved abrasion resistance, and reduced adherence to the print head without the associated coating problems addressed above.

SUMMARY OF THE INVENTION

The present invention provides a thermosensitive recording element comprising (a) a support; (b) at least one thermal layer comprising an organic polymeric binder, a substantially colorless electron donating dye precursor and an electron accepting compound capable of forming color by reacting with said dye precursor; and (c) a layer comprising a non-binder containing solution of a crosslinking agent wherein said agent forms an ether or diol-type Bond with the binder. The thermal layer is interposed between the support and layer (c), i.e., the layer comprising a non-binder containing solution of a crosslinking agent.

In another embodiment, there is provided a thermosensitive recording element comprising in order:

(a) a support;

(b) a first thermal layer comprising an organic polymeric binder and either a substantially colorless electron donating dye precursor, an electron accepting compound, or mixtures thereof;

(c) a second thermal layer comprising an organic polymeric binder compatible with the binder in (b) and either a substantially colorless electron donating dye precursor or an electron accepting compound; and (d) a layer comprising a non-binder containing solution of a cross-linking agent wherein said agent forms an ether or diol-type bond with the binder wherein both dye precursor and electron accepting compound are present in the element.

Other embodiments of the invention include processes for preparing these thermosensitive recording elements.

DETAILED DESCRIPTION OF THE INVENTION

Surprisingly and unexpectedly, it was found that a thermosensitive recording element having an overcoat layer comprising a non-binder containing solution of a crosslinking agent, did not result in premature crosslinking between the crosslinking agent and the polymeric binder in the underlying thermal layer. In other words, keeping the crosslinking agent containing layer separate from the thermal layer or binder containing layer or layers, prevents the occurrence of premature crosslinking, and the coating composition stability problems associated therewith.

Accordingly, the present invention provides a thermosensitive recording element comprising (a) a support, (b) at least one thermal layer comprising an organic polymeric binder, an electron donating dye precursor and an electron accepting compound, and (c) a layer comprising a non-binder containing solution of a crosslinking agent. The crosslinking agent forms a diol-type or ether-type bond with the organic polymeric binder in the underlying thermal layer.

Another thermosensitive recording element of the invention comprises (a) a support, (b) a first thermal layer comprising an organic polymeric binder and either a substantially colorless electron donating dye precursor, an electron accepting compound, or mixtures thereof, (c) a second thermal layer comprising an organic polymeric binder compatible with the binder in (b) and either a substantially colorless electron donating dye precursor or an electron accepting compound, and (d) an additional overcoat layer comprising a non-binder containing solution of a crosslinking agent wherein both dye precursor and electron accepting compound are present in the element. The crosslinking agent forms a diol-type or ether-type bond with the organic polymeric binder in the underlying thermal layer.

The term "thermal layer" as used herein means a layer that chemically reacts to produce colored compounds when thermal energy is applied to it as for example from a writing head on a thermal plotter or from infrared radiation from a light source such as a laser.

SUPPORTS

The thermosensitive recording layers of the invention rest on a support. Supports having a Sheffield smoothness of less than 60 are preferred. Sheffield smoothness is determined using the method described in TAPPI, T 5380M-88. Acceptable supports include sheet-formed materials such as paper, e.g., 100 percent bleached hard and softwood Kraft, 100 percent wood free cotton vellum, cotton vellum made translucent with polystyrene or mineral oil, and wood-containing paper made translucent either by pulp beating or with additives; transparent films such as polyethylene terephthalate; non-woven cloth; metal foil; and mixtures thereof. Paper is the preferred support in practicing the invention.

Supports may contain a sealant layer comprising an inorganic pigment, preferably a blend of inorganic pigments, and a latex sealant. The sealant layer allows for the reduction in coating weight of the layer or layers containing the dye precursor and the electron accepting compound without sacrificing image density. Some useful pigments include kaol in clay, e.g., calcined kaolin clay; calcium carbonate; titanium dioxide; barium sulfate, talc; etc. A preferred blend of pigments includes 70–80% kaolin clay, 15–20% calcium carbonate, and 5–20% titanium dioxide. Preferably the ratio of the pigments in the blend is 70:1.5:5%. Some useful latex sealants include acrylic resins, styrene-butadiene type resins, acetates, natural binders such as starches, and blends thereof. A preferred latex sealant is a styrene/-butadiene resin having a Tg of 3° C., and a minimum film forming temperature of +5° C. The latex sealant is present in the amount of 18–24% based on the total pigment weight, and preferably 19–22%.

ELECTRON DONATING DYE PRECURSOR

The thermosensitive recording elements of the invention contain a substantially colorless electron donating dye precursor. By the term "substantially colorless" it is meant having a background optical density of less than or equal to 0.10.

Electron donating dye precursors used in ordinary pressure-sensitive recording papers, thermosensitive recording papers, etc. are useful in practicing the present invention. Suitable electron donating dye precursors are disclosed in U.S. Pat. Nos. 4,889,841 issued to Kosaka et al., 4,885,271 issued to Kawakami et al., and 4,467,336 issued to Koike and include the following compounds:

(1) triarylmetnane compounds such as 3,3-bis(p-dimethylaminophenyl) -6-dimethylaminophthalide (Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3- (2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl) -5-dimethylaminophthalide, 3-p-dimethylaminophenyl-3-(1-methylpyrrol-2-yl) -6-dimethylaminophthalide, etc.;

(2) diphenylmethane compounds such as 4,4'-bis-dimethylaminobenzhydryl benzyl ether, N-halophenyl leuco Auramine, N-2,4,5-trichlorophenyl leuco Auramine, etc.;

(3) xanthene compounds such as Rhodamine B anilinolactam, Rhodamine B p-chloroanilinolactam, 3-diethylamino-7-dibenzylaminofluoran, 3-diethylamino-7octylaminofluoran, 3-diethylamino-7-(3,4-dichloroanilino) fluoran, 3-diethylamino-7- (2-chloroanilino) fluoran, 3-diethylamino-6-methyl-7-anilinofluoran, 3-piperidino-6-methyl-7-anilinofluoran, 3-ethyl-tolylamino-6-methyl-7-anilinofluoran, 3-ethyl-tolylamino-6-methyl-7-phenyl-fluoran, 3-diethylamino-7(4-nitroanilino) fluoran, 3-dibutylamino-6-methyl-7anilinofluoran, 3-(N-methyl-N-propyl)amino-6-methyl-7-anilinofluoran, 3-(N-ethyl-N-isopropyl)amino-6-methyl-7-anilinofluoran, 3-(N-ethyl-N-tetrahydrofurfuryl)amino-6-methyl-7-anilinofluoran, 3-(N-ethyl-N-isopentyl)amino-6-methyl-7-anilinofluoran, 3-(N-cyclohexyl-N-methyl)-amino-6-methyl-7-anilinofluoran, 3-diethylamino-6-methyl-7-anilinofluoran, 3-dibutylamino-6-methyl-7aninofluoran, 3-(N-ethyl-N-(3-ethoxy)propyl)anino-6-methyl-7-anilinofluoran, 3-dipentyl-amino-6-methyl-7-aninofluoran, etc.;

(4) thiazine compounds such as benzoyl leuco methylene blue, p-nitrobenzoyl leuco methylene blue, etc.; and (5) spiro compounds such as 3-methyl-spirodinaphthopyran, 3-ethyl-spirodinaphthopyran, 3,3'-dichlorospirodinaphthopyran, 3-benzylspirodinaphthopyran, 3-methylnaphtho-(3-methoxybenzo)spiropyran, 3-propyl-spirodibenzopyran, etc. Also useful are mixtures of these dye precursors.

Preferred electron donating dye precursors suitable for practicing the invention are (i) 3,3-bis(p-dimethylaminophenyl)-6-dimethylaminophathalide, (ii) 3-(N-ethyl-N-isopentyl)amino-6-methyl-7-aninofluoran, and (iii) 3-dipentyl-amino-6-methyl-7-aninofluoran. The electron donating dye precursor is present in the amount of 1 to 20 percent, preferably 8 to 15 percent, by weight based on the weight of the coating composition.

ELECTRON ACCEPTING COMPOUND

The thermosensitive recording elements of the invention also comprise an electron accepting compound. Suitable electron accepting compounds, also known as acidic developers, are disclosed in U.S. Patent Nos. 4,889,841 issued to Kasaka et al., 4,885,271 issued to Kawakami et al., and 4,467,336 issued to Koike. Specific electron accepting compounds suitable for practicing the invention include phenol derivatives, aromatic carboxylic acid derivatives, N,N'-diarylthiourea derivatives, and polyvalent metal salts such as zinc salts of organic compounds.

Particularly preferred are phenol derivatives. Specific examples include p-octylphenol, p-tertbutylphenol, p-phenylphenol, 1,1-bis (p-hydroxyphenylpropane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis (4'-hydroxyphenyl)propane, 2,2-bis(4-hydroxy-3-dichlorophenyl)propane, benzyl p-hydroxybenzoate, ethyl p-hydroxybenzoate, butyl p-hydroxybenzoate, p-p'-dihydroxy-diphenylsulfone, 2,2'-diallyl-4,4'-dihydroxydiphenylsulfone, and 2,2'-dimethyl-4,4'-dihydroxydiphenylsulfide. Mixtures of these compounds may also be used.

The electron accepting compounds are present in the amount of about 50 to 500 percent, preferably 150 to 350 percent, by weight based on the weight of the dye precursor.

BINDERS

Organic polymeric binders useful for practicing the invention are water soluble binders such as starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers such as poly(vinyl alcohol-co-vinyl acetate) also known as partially hydrolyzed polyvinyl alcohol, sodium alginate, water soluble phenol formaldehyde resins, styrene-maleic anhydride copolymer, ethylene-maleic anhydride copolymer, ethylene vinyl acetate polymers, etc.; latex type water soluble binders such as styrene-butadiene copolymer, acrylonitrile-butadiene copolymer, methyl acrylate-butadiene copolymer, etc., acrylic resins such as poly (methyl methacrylate/ethyl acrylate/acrylic acid), etc. Organic polymeric binders having a molecular weight of 10,000 to 200,000 are preferred.

The organic polymeric binder is present as an aqueous solution having a concentration of about 1 to 25 percent by weight, preferably about 10 to 25 percent by weight. If the concentration is less than 1 percent, stability of the dispersed particles is inferior and cohesion may occur during the heating step. If the concentration is greater than 25 percent, the viscosity of the dispersion increases remarkably, thus requiring a large amount of energy to carry out the dispersion. Viscosity is also dependent on the type of binder used.

CROSSLINKING AGENTS

The outermost layer of the thermosensitive element, of the invention is an overcoat layer comprising a non-binder containing solution of a crosslinking agent. The crosslinking agent reacts with the binder in the underlayer, i.e., the thermal layer beneath the outermost layer, to form a diol-type or ether-type bond. Some useful crosslinking agents that crosslink with organic polymeric binders to form diol-type bonds include boric acid, sodium borate, sodium molybdate, sodium silicate, etc. Crosslinking agents that form bonds other than ether or diol-type bonds may also be used in practicing the invention provided the crosslinking agent does not prematurely crosslink with the binder in the underlying thermal layer and provided improved abrasion resistance and reduced adherence to the print head are achieved.

Some useful crosslinking agents that crosslink with organic polymeric binders to form ether-type bonds include mono and polyfunctional aldehydes, e.g., formaldehyde, urea-formaldehyde and free dialdehydes, such as glyoxal, succinaldehyde and glutaraldehyde, blocked dialdehydes, epoxides, melamine, etc.

The crosslinking agent is present in the amount of about 20 to 80 percent based on the amount of organic polymeric binder present in the underlying thermal layer, and preferably about 30 to 85 percent.

CATALYST

Catalysts may be used in combination with the cross linking agent. Suitable catalysts are selected from the group consisting of mineral acids, e.g., hydrochloric, hydrobromic, sulfuric, nitric, phosphoric and boric acids; organic acids, e.g., p-toluenesulfonic, p-dodecylbenzene sulfonic, trichloroacetic, trifluoroacetic, perfluoroneptanoic, acetic, etc.; and an acid from a compound supplying acid, e.g., Lewis acid selected from the group consisting of zinc chloride, zinc bromide, ferric chloride, etc. In practicing the invention, a preferred catalyst is p-toluenesulfonic acid.

The catalyst is present in the amount of about 0.3 to 2 percent and preferably about 0.4 to 1 percent based on the amount of crosslinking agent.

ADDITIVES

Additives may be present in the dye precursor-containing layer and the developer-containing layer.

Acceptable additives include pigments, waxes, lubricants, activation cosolvents, higher fatty acid metal salts, surface active agents, mold inhibitors, dispersing agents, UV absorbing agents, fluorescent dyes, optical brighteners, defoaming agents, and the like. Also useful are heat fusible materials which may lower the melting point of the dye precursor or developer to improve heat sensitivity and color development at low temperatures. Preferably, the waxes and higher fatty acid metal salts are in the uppermost layer where they assist in preventing the thermosensitive element from sticking to or scratching the thermal head of the recording device.

Useful pigments include diatomaceous earth, talc, kaolin, sintered kaolin, calcium carbonate, magnesium carbonate, titanium oxide, zinc oxide, silicon oxide, aluminum hydroxide, urea-formalin resin, etc.

Useful heat fusible materials include $\beta$-naphtol benzylether, p-benzylbiphenyl, ethylene glycol m-tolyl ether, m-terphenyl, bis(2-(4-methoxy)phenoxyethyl)ether, dibenzyloxalate, di(p-chlorobenzyl) oxalate, di(p-methylbenzyl) oxalate and dibenzyl terephthalate. These heat fusible materials may be used in the amount of 25–500%, preferably 50 to 200%, by weight based on the weight of dye precursor.

Examples of higher fatty acid metal salts are zinc stearate, calcium stearate. Useful waxes include paraffin, oxidized paraffin, polyethylene, oxidized polyethylene, stearic amide and castor wax. Dispersing agents such as stearic acid, sodium dioctylsulfosuccinate, etc.; UV absorbing agents of the benzophenone type, benzotriazole type etc.; and mold inhibitors such as sodium-o-phenylpthenate tetrahydrate, etc. are also useful additives.

DISPERSION PREPARATION AND COATING

A process is provided for preparing a thermosensitive recording element having (a) a support; (b) at least one thermal layer comprising an organic polymeric binder, a substantially colorless electron dye precursor and an electron accepting compound capable of forming color by reacting with said dye precursor; and (c) an additional overcoat layer comprising a non-binder containing solution of a crosslinking agent wherein said agent forms ether or diol-type bond with the binder. The process comprises the steps of:

(a) providing a support;

(b) preparing a first dispersion of an aqueous solution comprising an organic polymeric binder and a substantially colorless, electron donating dye precursor;

(c) preparing a second dispersion of an aqueous solution comprising an organic polymeric binder compatible with the binder in (b), and an electron accepting compound capable of forming color by reaction with said dye precursor;

(d) mixing the first and second dispersions;

(e) applying the dispersion mixture onto the support;

(f) drying said dispersion to form a first layer on the support; and (g) applying a non-binder containing solution of a crosslinking agent to the layer formed in (f). The crosslinking agent forms a bond with the organic polymeric binder. The bond formed is a diol-type or ether-type bond.

The dye precursor and electron accepting compound containing dispersions are generally prepared with an aqueous solution of an organic polymeric binder as the dispersion medium. The dye precursor and the electron accepting compound in their respective dispersions have a particles size of about about 0.1–3 $\mu$, preferably less than 1 $\mu$. Thermal response in the thermosensitive element is generally insufficient if the particle size is greater than 3 $\mu$.

The dispersion applied to the support comprises a polymeric binder, a dye precursor, and an electron accepting compound. The ratio of the dye precursor to the electron accepting compound in this layer is in the range of about 0.5:1 to 1:10, preferably about 1:2 to 1:4.

The dispersion containing the dye precursor is prepared by grinding the dye precursor and optionally other suitable additives along with an aqueous solution of an organic polymeric binder in a grinding device such as a ball mill; sand mill, such as a horizontal sand mill; an attritor, etc. Preferably a horizontal sand mill containing zircon lure silicate media is used. The dispersion is subjected to continuous grinding until an average particle size of about 0.1–3 $\mu$, preferably less than 1 $\mu$ is reached.

The electron accepting compound containing dispersion is prepared by grinding the electron accepting compound, aqueous solution of an organic polymeric binder and suitable additives in one of the above-described grinding devices, until an average particle size of about 0.1–3 $\mu$, preferably less than 1 $\mu$, is reached.

The binder in the electron accepting compound containing dispersion must be compatible with the binder in the dye precursor containing dispersion. By the term "compatible with the binder" it is meant that the binders in the dispersions be either identical to or do not cause precipitation of each other. For example, it is important that the binders are miscible with one another and that they do not chemically react with one another.

Alternatively, separate dispersions containing either the dye precursor, or the electron accepting compound, or any of the other additives may be prepared by grinding the individual ingredients along with an aqueous solution of the organic polymeric binder in a grinding device until the desired average particle size is reached. Coating dispersions or compositions may then be prepared by blending the individual dispersions in ratios that produce the desired weight percent of the individual ingredients as a percentage of total weight of the coating dispersion.

Another process is provided for preparing a thermosensitive recording element comprising (a) a support; (b) at least two thermal layers; and (c) a layer having a non-binder containing solution of crosslinking agent wherein said agent forms an ether or diol-type bond with the binder in the underlying thermal layer. The process comprises the steps of:

(a) providing a support;

(b) preparing a first dispersion of an aqueous solution of an organic polymeric binder, and a substantially colorless, electron donating dye precursor;

(c) preparing a second dispersion of an aqueous solution of an organic polymeric binder compatible with the binder in (b) and an electron accepting compound;

(d) applying either the first dispersion, the second dispersion or a mixture thereof onto the support;

(e) drying the first applied dispersion to form a first layer on the support;

(f) applying either the first or the second dispersion on the first layer formed in step (e) thereby forming a second later;

(g) drying the second layer; and (h) applying a non-binder containing solution of a crosslinking agent to the second layer formed in (f). The crosslinking agent in the overcoat layer forms a bond with the organic polymeric binder in the underlying thermal layer. The bond formed is a diol-type or ether-type bond.

In each of the above-described processes, the dispersions comprising dye precursor and electron accepting compound are mixed using conventional mixing devices known to one skilled in the art and the dispersion mixture is applied, preferably coated, using any conventional coating apparatus, onto a support, preferably paper, followed by drying at about 25° to 50° C., preferably 45° to 50° C. for 0.025 to 30 minutes, preferably 0.025 to 5 minutes. The dye precursor in the coated layer is present in the amount of 0.3 g/m$^2$ to 1.6 g/m$^2$, preferably 0.4 g/m$^2$ to 0.8 g/m$^2$. The electron accepting compound in the coated layer is present in the amount of 0.2 g/m$^2$ to 2.7 g/m$^2$, preferably 0.7 g/m$^2$ to 1.6 g/m$^2$. Alternatively, the electron accepting compound is present in an amount equal to 50–500 percent, preferably 150–350 percent by weight based on the weight of dye precursor present in the layer. After drying, additional layers if present may be applied, preferably coated onto the dried first layer followed by drying under the same conditions. It is preferred that drying is conducted in such a fashion that the moisture content of the thermosensitive recording element is within the range of from about 5 percent by weight to about 9 percent by weight based on the total weight of the recording element.

Additional layers may be applied to the non-binder containing overcoat layer of the dried recording element thus described to impart different surface characteristics such as gloss, smoothness, color, resistance to inorganic or organic solvents, and additional abrasion resistance. Additional thermal layers may also be present comprising an organic polymeric binder, compatible with the binder in the adjacent layer, and a dye precursor or an electron accepting compound. Preferably this additional thermal layer is beneath the non-binder containing overcoat layer. However, in an element having more than two layers, it is preferred that the two outermost layers of the recording element be free of dye precursor. This prevents smearing from the trailing edge of the image. In addition to a polymeric binder, the additional layer or layers may comprise compounds selected from the group consisting of pigments, waxes, higher fatty acid metal salts, optical brighteners, and mixtures thereof. The cumulative amount of electron accepting compound in all layers of the composition should fall in the range of 50–500 percent, preferably 150–350 percent by weight based on the total amount of dye precursor used in the coated material.

An insulating layer comprising a resin and spherical beads, preferably hollow beads, may be provided between the support and the thermal coating layer adjacent to the support to reflect heat to the thermal coating instead of allowing the heat to be absorbed by the support and therefore lost. This produces a thermosensitive recording element having improved thermal sensitivity and a whiter surface. The spherical beads are selected from the group consisting of polystyrene, diene copolymer, acrylic, methacrylic, glass, ceramic and plastic beads. The resin should be compatible with the organic polymeric binder in the adjacent layer. Preferably, the beads are uniform in particle size, and preferably 0.5 micron in size.

A backcoating may also be provided on the surface of the support away from the thermal coating to reduce curl. The backcoat may be comprised of a resin, preferably an acrylic resin and a filler type material such as calcium carbonate, titanium dioxide, etc.

After drying, a non-binder containing solution of a crosslinking agent is applied to the outermost thermal layer of the thermosensitive recording element. The crosslinking agent forms a bond with the organic polymeric binder present in the underlying thermal layer and the type of bond formed is a diol-type or ether-type bond. The non-binder containing solution of a crosslinking agent is prepared by adding the crosslinking agent to water, preferably deionized water, to produce concentrations ranging from 1–40 percent and preferably 5–9 percent of crosslinking agent based on the weight of the crosslinking solution. The concentration of crosslinking agent depends on the type of crosslinking agent used. Optical brighteners or ultraviolet absorbing chemicals may be added to the non-binder containing solution of the crosslinking agent.

Thus, the layer containing the crosslinking agent is separated from the binder containing layer until after the dye and developer containing layer or layers are coated, thus significantly reducing the stability problems associated with the binder prematurely crosslinking with the crosslinking agent.

The thermosensitive recording elements of the invention are hard, have a low coefficient of friction, and are remarkably resistant to abrasion and water staining. In addition, the elements of the invention do not stick to thermal print heads.

The following examples further illustrate, but do not limit, the invention. The parts and percentages are by weight unless otherwise noted. Average particle size was measured using a Microtrac II laser light particle size analyzer, available from Northrup & Leeds Co., St. Petersburg, Fla.

The following dispersions were prepared:

Dispersion "A" (Developer Dispersion):

| INGREDIENT | WT. % |
|---|---|
| Bisphenol A, Aristech Chemical Corp. (Polycarbonate grade), Pittsburgh, PA | 64.0 |
| Titanium dioxide, E. I. du Pont de Nemours and Co., Wilmington, DE | 16.0 |
| Elvanol ® 51-05 (14% solution) E. I. du Pont de Nemours and Co., Wilmington, DE | 20.0 |

The above ingredients were placed in a Cowles disperser and dispersed for approximately 20 minutes. The solids were adjusted with deionized water to give a 30% solids dispersion. The mixture was then pumped into a horizontal media mill (Model EHP), Premier Mill Corp., Reading, Pa. for grinding into fine particles. The ingredients were subjected to continuous grinding until a mean particle diameter of approximately 1 micron or less was obtained.

Dispersion "B" (Dye Precursor Dispersion):

| INGREDIENT | WT. % |
|---|---|
| Black 305 dye, Nagase America Corp., NY, NY | 42.88 |
| Zinc Stearate, Huls America Inc., Piscataway, NJ | 21.24 |
| Stearic Acid, Henkel Corp., Cincinnati, OH | 10.57 |
| Elvanol ® 51-05 (Du Pont) (14% solution) | 24.96 |
| Blankophor ® P-167, Mobay Corporation, Pittsburgh, PA | 0.35 |

Elvanol ® and black dye were added to a Cowles disperser and stirred for 20 minutes. Zinc stearate and stearic acid were added to the dispersion and the mixture was dispersed for approximately 20 minutes. The total solids were adjusted with deionized water to 32%. The dispersion was coarse and was pumped into a Premier Mill similar to that described-above and ground to give a bimodal dispersion. The mean particle diameter of the dye component, which was the finer material, was about 1 micron or less. Blankophor ® P-167 predissolved in deionized water was then added to bring the total solids to 30%.

Dispersion "C" (Developer and Dye Precursor Dispersion)

454 grams of the Dispersion "B" and 908 grams of dispersion "A" were mixed with a Model XJA-33 (or DS 1010) Lightening Mixer, Mixing Equipment Co., Rochester, N.Y. to produce a homogeneous mixture.

Dispersion "D" (Insulating Layer Dispersion):

Ropaque ® HP-91 (Rohm & Haas Company, Philadelphia, Pa.) was dispersed in Joncryl ® 77 (S. C. Johnson Wax, Specialty Chemicals, Racine, Wis.) with a Lightening Mixer, Model MSV1500V to produce a dispersion having a pigment to binder ratio of 4:1, based on the total weight of the solids. The total non-volatile solids of the dispersion was adjusted to 30% with deionized water.

Crosslinking Agent Solution "A"

A sodium borate solution was prepared by adding disodium octaborate tetrahydrate to deionized water while stirring to produce concentrations of 5–9% by weight of sodium borate based on the total weight of the solution.

Crosslinking Agent Solution "B"

A 40% by weight solution of glyoxal (Aldrich Chemical Co., Milwaukee, Wis.) was diluted with deionized water to produce a 5% by weight solution.

Crosslinking Agent Solution "C"

Deionized water was used as Solution "C" and served as a control.

Cross linking Agent Containing Overcoat Solution "D"

100 grams of a 14% solution of Elvanol® and 1.75 grams of a 40% solution of glyoxal were placed in a container and dispersed with a Lightening Mixer, Model MSV1500V to form a solution.

In some of the following examples, a backcoating of resin and filler-type material was provided on the surface of the support away from the thermosensitive coating to reduce curl.

Example 1

Three thermosensitive recording elements were prepared according to the following procedure:

A No. 50 Ultragraphic base paper sheet (Silver Leaf Paper Co., Columbus, Ohio) was coated with Dispersion "C" using a No. 10 Meyer rod. The coating was dried so that the sheet temperature did not exceed 135° F. Dry coating weight was between 1.64 g/m$^2$ and 3.26 g/m$^2$.

Over this coating for each of the three elements, a non-binder containing crosslinking solution "A" (Sodium borate - Sample 1), "B" (Glyoxal - Sample 2) or "C" (water - Sample 3), respectively, was applied. A zero Meyer rod was used to apply the coating. The solution was dried so that the sheet temperature did not exceed 135° F. The dry coat weight was less than 0.49 g/m$^2$.

The paper was printed in a Gulton Model SP 80 ATSBI thermal printer, Gulton Co., East Greenwich, R.I. Results are shown in Table 1 below.

TABLE 1

| SAMPLE | CROSS-LINKING AGENT | STICKING TO PRINT HEAD | ABRASION RESISTANCE |
|---|---|---|---|
| SAMPLE 1 | SODIUM BORATE | NO | EXCELLENT |
| SAMPLE 2 | GLY-OXAL | SLIGHT | VERY GOOD |
| SAMPLE 3 | WATER | YES | ACCEPTABLE |

Example 2

Example 1 was repeated with the following exceptions: Dispersion "B" was coated on the base paper sheet and dried followed by coating with Dispersion "A" and drying. The dry coat weight of Dispersion "A" was between 0.81 g/m$^2$ and 2.44 g/m$^2$. The dry coat weight of Dispersion "B" coating was between 0.81 g/m$^2$ and 2.44 g/m$^2$. Results are shown in Table 2 below.

TABLE 2

| SAMPLE | CROSS-LINKING AGENT | STICKING TO PRINT HEAD | ABRASION RESISTANCE |
|---|---|---|---|
| SAMPLE 1 | SODIUM BORATE | NO | EXCELLENT |
| SAMPLE 2 | GLY-OXAL | VERY SLIGHT | VERY GOOD |
| SAMPLE 3 | WATER | YES | GOOD |

Example 3

Example 2 was repeated with the following exception:Dispersion "A" was coated on the paper base sheet and dried followed by coating with Dispersion "B". Results are shown in Table 3 below.

TABLE 3

| SAMPLE | CROSS-LINKING AGENT | STICKING TO PRINT HEAD | ABRASION RESISTANCE |
|---|---|---|---|
| SAMPLE 1 | SODIUM BORATE | NO | VERY GOOD |
| SAMPLE 2 | GLY-OXAL | SLIGHT | VERY GOOD |
| SAMPLE 3 | WATER | YES | GOOD |

Example 4

Example 1 was repeated with the following exception:A 0.1 mm thick polyethylene terephthalate sheet was used instead of the base paper sheet. Results are shown in Table 4 below.

TABLE 4

| SAMPLE | CROSS-LINKING AGENT | STICKING TO PRINT HEAD | ABRASION RESISTANCE |
|---|---|---|---|
| SAMPLE 1 | SODIUM BORATE | NO | VERY GOOD |
| SAMPLE 2 | GLY-OXAL | SLIGHT | GOOD |
| SAMPLE 3 | WATER | YES | ACCEPTABLE |

Example 5

Example 2 is repeated except that a 0.1 mm thick polyethylene terephthalate sheet is used instead of the base paper sheet. It is expected that the results would be similar to those obtained for Example 2.

Example 6

Example 1 was repeated with the following exception: Dispersion "D" was coated on the base paper sheet with a No. 6 Meyer rod and dried. The dried coating weight was approximately 1.6 g/m$^2$. Dispersion "C" was then coated on dried Dispersion "D". Results are shown in Table 5 below.

TABLE 5

| SAMPLE | CROSS-LINKING AGENT | STICKING TO PRINT HEAD | ABRASION RESISTANCE |
|---|---|---|---|
| SAMPLE 1 | SODIUM BORATE | NO | VERY GOOD |
| SAMPLE 2 | GLY-OXAL | SLIGHT | GOOD |
| SAMPLE 3 | WATER | YES | ACCEPTABLE |

Example 7

Example 6 was repeated with the following exception:A 0.1 mm thick polyethylene terephthalate sheet was used instead of the base paper sheet. Results are shown in Table 5 below.

TABLE 6

| SAMPLE | CROSS-LINKING AGENT | STICKING TO PRINT HEAD | ABRASION RESISTANCE |
|---|---|---|---|
| SAMPLE 1 | SODIUM BORATE | YES | GOOD |
| SAMPLE 2 | GLY-OXAL | YES | GOOD |
| SAMPLE 3 | WATER | YES | ACCEPTABLE |

Use of the polyethylene terephthalate sheet and the additional layer increases the thickness of the element resulting in poor feeding through the Gulton printer, and therefore, sticking to the print head.

Example 8

Five thermosensitive recording elements were prepared according to the procedure described below:

A No. 50 Ultragraphic base paper sheet (Silver Leaf Paper Co., Columbus, Ohio) was coated with Dispersion "C" using a No. 10 Meyer rod. The coating was dried so that the sheet temperature did not exceed 135° F. Dry coating weight was between 1.64 g/m$^2$ and 3.26 g/m$^2$.

Over this coating, for two of the elements, non-binder containing crosslinking solutions "A" (Sodium borate-Sample 1) or "B" (Glyoxal - Sample 2), respectively, were applied. A zero Meyer rod was used to apply the coating. The solution was dried so that the sheet temperature did not exceed 135° F. The dry coat weight was less than 0.49 g/m$^2$.

Sample 3 was prepared by overcoating dried Dispersion "C" on the base paper sheet with binder containing crosslinking solution "D" (Control 1).

Sample 4 (Control 2) having a 5% solution of sodium borate and Elvanol® could not be coated because the sodium borate reacted with the Elvanol® prior to coating to form a very high viscosity insoluble gel. Dispersions containing smaller concentrations of sodium borate may be coatable.

The fifth sample was not overcoated (Control 3).

The papers were printed in a Gulton Model SP 80 ATSBI thermal printer, Gulton Co. , East Greenwich, R.I. Results are shown in Table 7 below.

TABLE 7

| SAMPLE | CROSS-LINKING AGENT | STICKING TO PRINT HEAD | ABRASION RESISTANCE |
|---|---|---|---|
| SAMPLE 1 | SODIUM BORATE | NO | EXCELLENT |
| SAMPLE 2 | GLY-OXAL | NO | VERY GOOD |
| CONTROL 1 | GLY-OXAL | VERY SLIGHT | VERY GOOD |
| | CONTAINING OVERCOAT | | |
| CONTROL 2 | — | — | — |
| CONTROL 3 | — | YES | ACCEPTABLE |

The papers were tested on a Atlantek® Thermal Response Tester, Model 200, Atlantek Corp., Wakefield, R.I. Results are shown in Table 8 below.

TABLE 8

| SAMPLE | AMOUNT OF THERMAL ENERGY APPLIED TO PAPER | | | | |
|---|---|---|---|---|---|
| | 0 mJ | .14 mJ | .23 mJ | .36 mJ | .46 mJ |
| | REFLECTION DENSITY | | | | |
| SAMPLE 1 | 0.08 | 0.08 | 0.48 | 1.39 | 1.57 |
| SAMPLE 2 | 0.08 | 0.13 | 0.78 | 1.53 | 1.55 |
| CONTROL 1 | 0.08 | 0.11 | 0.44 | 1.21 | 1.34 |
| CONTROL 2 | — | — | — | — | — |
| CONTROL 3 | 0.07 | 0.12 | 0.59 | 1.46 | 1.48 |

Results show that a binder and crosslinking agent containing overcoat reduces thermal sensitometric response.

What is claimed is:

1. A thermosensitive recording element comprising in order:

(a) a support;

(b) at least one thermal layer comprising an organic polymeric binder, a substantially colorless electron donating dye precursor and an electron accepting compound capable of forming color by reacting with said dye precursor; and (c) a layer coated from a non-binder containing solution of a crosslinking agent wherein said agent forms a diol or ether bond with the binder in the underlying thermal layer;

2. A thermosensitive recording element comprising in order:

(a) a support;

(b) a first thermal layer comprising an organic polymeric binder and either a substantially colorless electron donating dye precursor, an electron accepting compound, or mixtures thereof;

(c) a second thermal layer comprising an organic polymeric binder compatible with the binder in (b) and either a substantially colorless electron donating dye precursor or an electron accepting compound; and (d) a layer containing a non-binder containing solution of a crosslinking agent wherein said agent forms an ether or diol bond with the binder in the underlying thermal layer;

wherein said first layer is interposed between said support and said second layer;

3. The thermosensitive recording element of claim 1 or 2 wherein the crosslinking agent forms a diol bond with the organic polymeric binder.

4. The thermosensitive recording element of claim 3 wherein the crosslinking agent is boric acid.

5. The thermosensitive recording element of claim 3 wherein the crosslinking agent is sodium borate.

6. The thermosensitive recording element of claim 1 or 2 wherein the crosslinking agent forms an ether bond with the organic polymeric binder.

7. The thermosensitive recording element of claim 6 wherein the crosslinking agent is selected from the group consisting of monofunctional aldehydes, polyfunctional aldehydes, free dialdehydes, epoxides and melamine.

8. The thermosensitive recording element of claim 7 wherein the crosslinking agent is glyoxal.

9. The thermosensitive recording element of claim 1 or 2 wherein the support is a sheet material.

10. The thermosensitive recording element of claim 9 wherein the support is paper.

11. The thermosensitive recording element of claim 10 wherein the support is coated with a sealant layer.

12. The thermosensitive recording element of claim 11 wherein the sealant layer comprises an inorganic pigment and a latex sealant.

13. The thermosensitive recording element of claim 1 or 2 wherein the substantially colorless electron donating dye precursor is selected from the group consisting of triarylmethane compounds, diphenylmethane compounds, xanthene compounds, thiazine compounds and spiro compounds.

14. The thermosensitive recording element according to claim 1 or 2 wherein the electron accepting compound is selected from the group consisting of phenol derivatives, aromatic carboxylic acid derivatives, N,N'-diarylthiourea derivatives, and polyvalent metal salts.

15. The thermosensitive recording element of claim 1 or 2, wherein the electron accepting compound is present in the amount of 50 to 500% by weight based on the weight of the dye precursor.

16. The thermosensitive recording element of claim 1 or 2 wherein the organic polymeric binder is a water soluble binder having a molecular weight of 10,000 to 200,000.

17. The thermosensitive recording element of claim 1 or 2 wherein the organic polymeric binder is selected from the group consisting of starches, hydroxyethyl cellulose, methyl cellulose, carboxymethyl cellulose, soluble collagen, gelatin, casein, polyacrylamide, polyvinyl pyrrolidone, polyvinyl alcohol, polyvinyl alcohol copolymers, sodium alginate, water soluble phenol formaldehyde resins, styrene-maleic anhydride copolymer, ethylene-maleic anhydride copolymer, ethylene vinyl acetate polymers, styrene-butadiene copolymer, acrylonitrilebutadiene copolymer, methyl acrylate-butadiene copolymer and acrylic resins.

18. The thermosensitive recording element of claim 17 wherein the organic polymeric binder is present as an aqueous solution having a concentration of 1 to 25 percent by weight.

19. The thermosensitive recording element of claim 1 or 2 wherein a backcoating is provided on the surface of the support opposite the surface having the thermal layer.

20. The thermosensitive recording element of claim 2 wherein at least one additional thermal layer is present on said second layer.

21. The thermosensitive recording element of claim 20 wherein the additional layer comprises an organic polymeric binder and either a dye precursor or an electron accepting compound.

22. The thermosensitive recording element of claim 2 wherein an additional layer is present between the support and the thermal layer adjacent the support, said additional layer comprising spherical beads and a resin.

23. The thermosensitive recording element of claim 22 wherein the spherical beads are selected from the group consisting of polystyrene, diene copolymer, acrylic, methacrylic, glass, and ceramic.

* * * * *